United States Patent [19]

Labbe et al.

[11] 4,357,067

[45] Nov. 2, 1982

[54] CONNECTOR FOR A COAXIAL CABLE

[75] Inventors: Jacques Labbe, La Garenne Colombes; Roland Bernollin, Lamastre, both of France

[73] Assignee: Les Cables de Lyons, Lyons, France

[21] Appl. No.: 207,036

[22] Filed: Nov. 14, 1980

[51] Int. Cl.[3] ..... H01K 17/18

[52] U.S. Cl. ..... 339/177 R; 339/177 F

[58] Field of Search ..... 339/177

[56] References Cited

U.S. PATENT DOCUMENTS

| | | | |
|---|---|---|---|
| 3,184,706 | 5/1965 | Atkins | 339/177 |
| 3,613,050 | 10/1971 | Andrews | 339/177 R |
| 3,982,060 | 9/1976 | Avery et al. | 339/177 R X |
| 4,156,554 | 5/1979 | Aujla | 339/177 R |
| 4,167,300 | 9/1979 | Fischer et al. | 339/177 R X |

FOREIGN PATENT DOCUMENTS

| | | |
|---|---|---|
| 1233828 | 12/1960 | France . |
| 2178181 | 9/1973 | France . |
| 1022288 | 3/1966 | United Kingdom . |

OTHER PUBLICATIONS

"Review of the Electrical Communication Laboratories", vol. 24, No. 9-10, Sep. Oct. 1976, Umezawa et al.

*Primary Examiner*—Joseph H. McGlynn
*Assistant Examiner*—Frank H. Kenzie, Jr.
*Attorney, Agent, or Firm*—Sughrue, Mion, Zinn, Macpeak & Seas

[57] ABSTRACT

A connector for a coaxial cable which includes, from the inside to the outside, a central conductor or core (1), an electrically insulative covering, an outer conductor (4) and a sheath (5), wherein said connector includes an outer body (10) which surrounds an insulating sleeve (13) disposed round a conductive connection member (14) whose rear end is connected by means of a hoop to the outer conductor (4) of said cable, said conductive connection member itself surrounding, firstly at its front end an annular conductor (18) which opens out at the front end of the connector and secondly in its mid-portion two concentric parts (19,20) of conical cross-section between which the end of said electrically insulative covering is gripped, said conical parts being clamped by means of a clamping component (25) which abuts against a distance piece (26), an insulating sleeve (28) being disposed between said annular conductor, said conductive connection member and an annular part (29) connected to the front portion of said outer body and surrounding the front end of the connector, an insulating part (33) also being disposed at the front end of said annular connector and a pin (34) connected to the core of said cable, insulating bushes (35,36,37) also being provided round said core in the mid-portion of the connector. The invention is applied to undersea high-frequency technologies.

6 Claims, 4 Drawing Figures

CONNECTOR FOR A COAXIAL CABLE

The present invention relates to a connector for a coaxial cable.

BACKGROUND OF THE INVENTION

It is known that for high-frequency applications, cable connectors must provie connection without degrading the electrical characteristics while having high mechanical strength.

Further, such connectors must often also be hermetically sealed, in particular in the case of undersea applications where they may be subjected to high hydrostatic pressures.

In known connectors, the function of electrically connecting a conventional coaxial cable to the connector itself is dissociated from the function of transmitting the mechanical force exerted on the cable and on the connector. For this purpose, firstly, metal armouring or braid is associated with the cable and secondly conventional mechanical means e.g. a cable clamp, are associated with the connector.

Such dispositions are of complex structure; their dimensions are too large and they are expensive to manufacture.

The Applicant has therefore sought to produce a connector which can perform simultaneously the electric connection function and the function of transmitting mechanical force, while providing a hermetic seal and high dielectric strength.

SUMMARY OF THE INVENTION

The present invention provides a connector for a coaxial cable which includes, from the inside to the outside, a central conductor or core, an electrically insulative covering, an outer conductor and a sheath, wherein said connector includes an outer body which surrounds an insulating sleeve disposed round a conductive connection member whose rear end is connected by means of a hoop to the outer conductor of said cable, said conductive connection member itself surrounding, firstly at its front end an annular conductor which opens out at the front end of the connector and secondly in its midportion two concentric parts of conical cross-section between which the end of said electrically insulative covering is gripped, said conical parts being clamped by means of a clamping component which abuts against a distance piece, an insulating sleeve being disposed between said annular conductor, said conductive connection member and an annular part connected to the front portion of said outer body and surrounding the front end of the connector, an insulating part also being disposed at the front end of said annular connector and a pin connected to the core of said cable, insulating bushes also being provided round said core in the mid-portion of the connector.

BRIEF DESCRIPTION OF THE DRAWINGS

An embodiment of the invention is described by way of example with reference to the accompanying drawings in which.

DESCRIPTION OF PREFERRED EMBODIMENT

Figure 1:
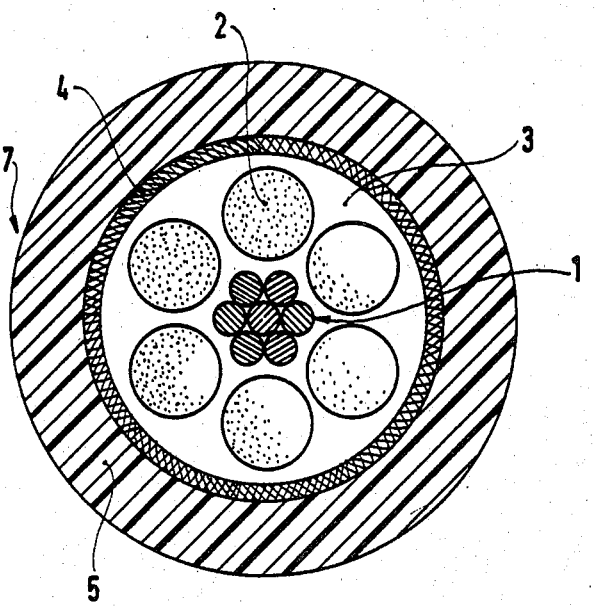
FIG. 1 illustrates a cable structure to which the connector in accordance with the invention is connected.

FIG. 1 illustrates a cable structure 7 to which a connector in accordance with the invention is connected, said structure also being described in published French Pat. No. 2,414,243 corresponding to U.S. patent application Ser. No. 944 of Jan. 4, 1979 and in its published French certified addition application No. 2,447,081 entitled "An electric cable with a longitudinal strength member".

Such a structure includes a non-swaged central conductor or core 1 formed e.g. by seven copper wires twisted together. Said conductor has an electronically insulating covering formed by six cords 2 (trade mark Cef) made of fine fibres of aromatic polyamide (trade mark Kevlar) marketed by Dupont de Nemours, which fibres are braided and impregnated with a hardening resin. These cords are embedded in polyethylene insulation 3 which for clearness' sake is not shaded in the figure. The outer conductor is constituted by a copper wire braid 4. The assembly is surrounded by a polyvinyl chloride or polyethylene sheath 5.

Figure 2:
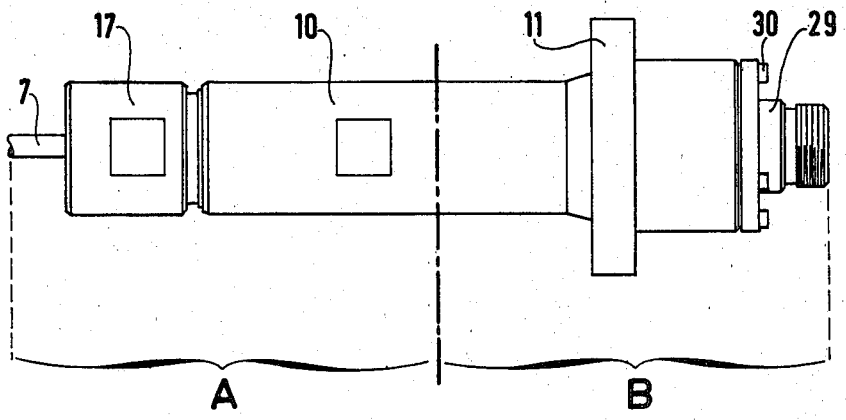
FIG. 2 illustrates an outside view of the connector in accordance with the invention.
Figure 3A:
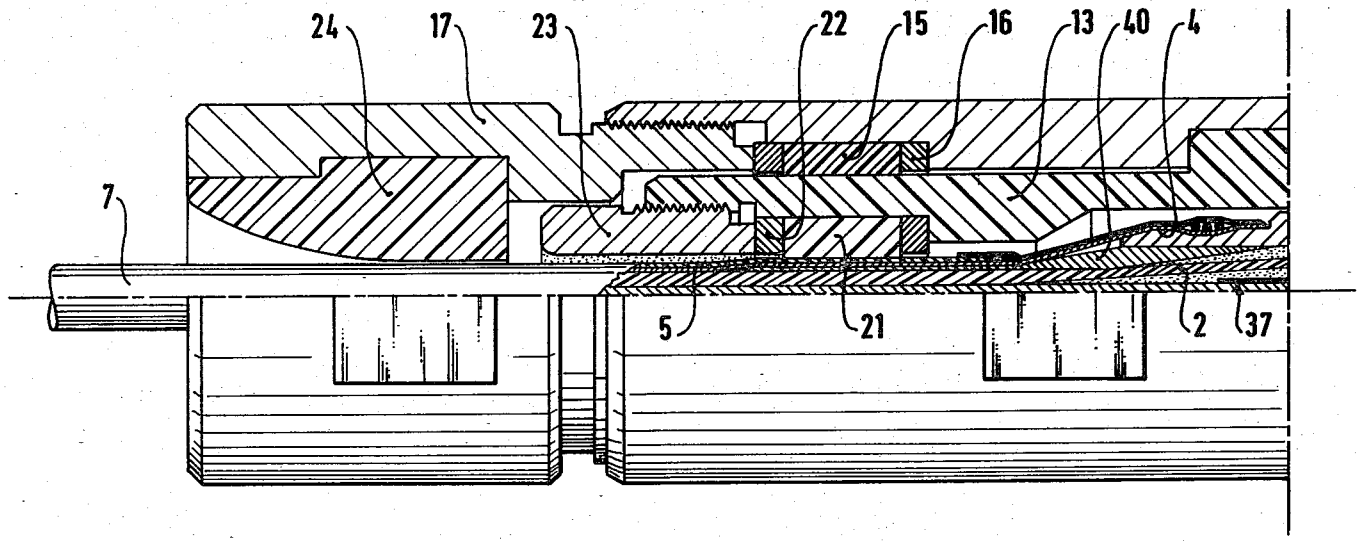
FIGS. 3A and 3B together constitute a longitudinal half section of the connector of FIG. 2.
Figure 3B:
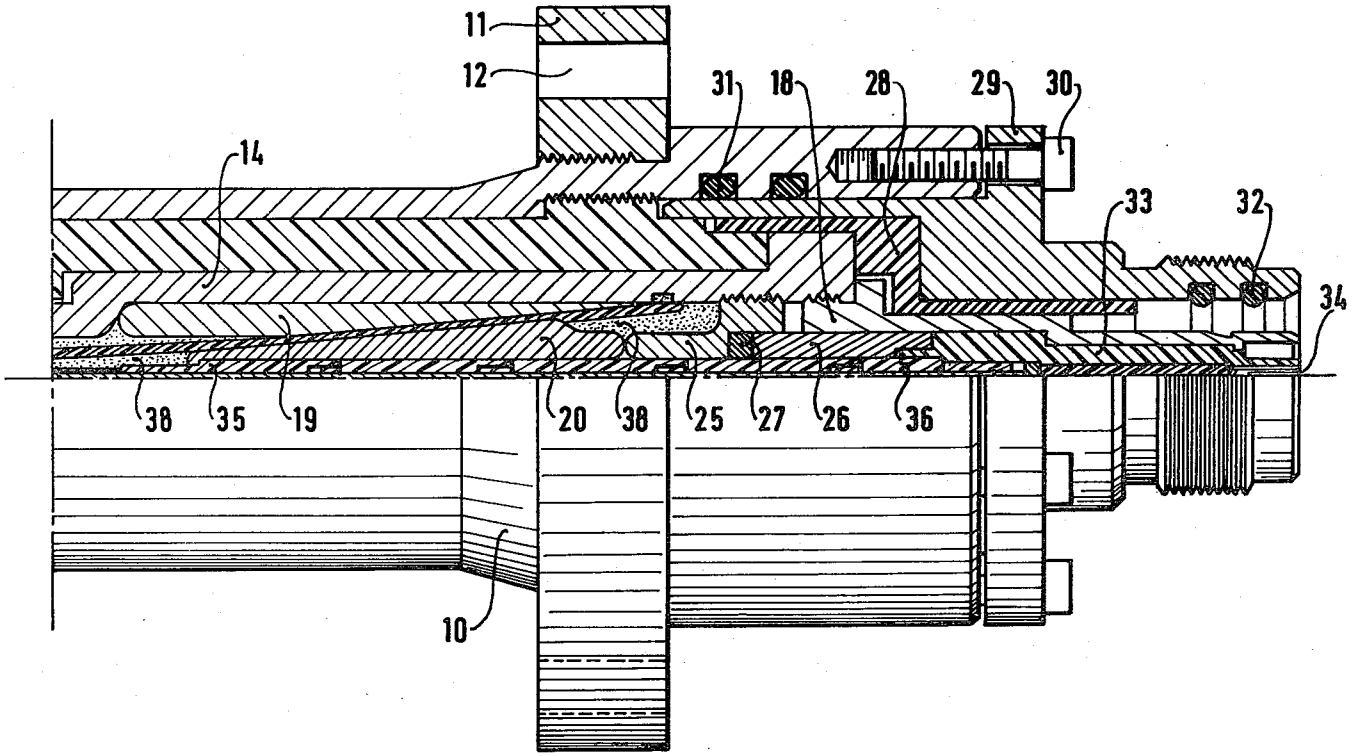

FIGS. 2, 3A and 3B illustrate a connector in accordance with the invention for connecting a cable 7 which arrives at the rear of said connector.

Said connector is of generally cylindrical shape. It includes an outer metal body 10 which is integral with a flange 11 which is pierced e.g. with six holes 12 to receive fixing bolts (not shown) for the connector. The body 10 surrounds an electrically insulative sleeve 13 which itself surrounds a conductive connection member 14. Said connection member extends substantially from the mid-portion to the front portion of the sleeve. Further, an outer packing gasket 15 co-operates with washers 16, the assembly being disposed between the rear portion of the body 10 and the sleeve 13. Said packing gasket 15 is tightened by means of a hollow outer nut 17.

Said conductive connection member 14 is disposed at its front end round an annular conductor 18 which opens out at the front end of the connector, and at its mid-portion it holds two parts 19 and 20 which are of conical concentric cross-section.

Further, an inner packing gasket 21 co-operates with washers 22, the assembly being disposed between the rear part of the sleeve 13 and the cable 7; said packing gasket is tightened by means of an inner nut 23.

The figures also show a guide part 24 disposed round the cable 7 and inside the hollow portion of the nut 17. Such a part is intended to reduce bending stresses on said cable.

A part referenced 25 is suitable for clamping the conical parts 19 and 20. It also abuts against a distance piece 26 via a resilient washer 27 or a stack of metal washers whose exact length is defined when assembling the connection and therefore makes it possible to compensate play as much as possible.

An insulating sleeve 28 is disposed between the annular conductor 18, the connection member 14 and a part 29 referred to as the outlet member of the connector. Said outlet member 29 is fixed by means of screws 30 to the body 10, seal rings 31 and 32 being disposed in recesses provided in the front portions of the body and of said outlet member 29 respectively.

Further, at the front of the connector, an insulating part 33 is disposed between the annular conductor 18 and a pin 34 installed inside the annular conductor 18.

Lastly, insulating bushes such as 35, 36 and 37 are provided in contact with and round the core 1 of the cable (not referenced) at the centre of the connector.

The various components of the cable 7 are connected to the connector in accordance with the invention as follows.

The cable 7 is inserted in the rear of the connector.

The central conductor or core 1 (not referenced in the figures) is connected directly to the pin 34 at the front of the connector. The ends of the Kevlar cords are gripped between the parts 19 and 20 of conical cross-section, a polymerisable insulating compound 38 advantageously being cast in spaces defined by said parts 19 and 20, the connection member 14, the part 25 and the insulating bushes 35 and 37, a nozzle-shaped ring 40 also being provided to maintain the Kevlar cords 2. Further, said ring 40, one of whose ends is inserted under the braid 4 of the cable is also intended to mechanically strengthen said cable so as to prevent it from being crushed by the pressure exerted by seal 21. It also makes the screen continuous and maintains impedance.

It is also seen that the end of the braid 4 is bound on and soldered to the rear end of the conductive connection member 14.

As far as concerns the sheath 5, it ends substantially level with the ring 40 and is held by the hoop of the braid 4.

Now, on examining the front of the connector, it is therefore seen that the potential of the core 1 of the cable is collected at the pin 34 and that the potential of the braid 4 is collected level with the annular conductor 18 via the conductive connection member 14.

It is therefore seen that the structure of the connector in accordance with the invention provides for various functions to be performed simultaneously.

Firstly, it allows its output to obtain three separate potentials, namely, the potential of the core 1 of the cable, the potential of the braid 4 and the potential of the body 10 while maintaining the electric impedance of the cable, the difference between said potentials may be as high as at least 10 kV.

Further, the use of an insulating sleeve 13 not only separates the potentials but also transmits the mechanical compression forces which may be at least 2000 kg.

Also, the use of seals and packing boxes makes sealing possible at minimum outside pressures of about 100 bars.

The invention can be applied with particular advantage to undersea high-frequency technologies.

We claim:

1. A connector for a coaxial cable which includes, from the inside to the outside, a central conductor or core, an electrically insulative covering, an outer conductor and a sheath, wherein said connector includes an outer body which surrounds an insulating sleeve disposed around a conductive connection member whose rear end is connected by means of a hoop to the outer conductor of said cable, said conductive connection member itself surrounding, firstly at its front end an annular conductor which opens out at the front end of the connector and secondly in its mid-portion two concentric parts of conical cross-section between which the end of said electrically insulative covering is gripped, said conical parts being clamped by means of a clamping component which abuts against a distance piece, an insulating sleeve being disposed between said annular conductor, said conductive connection member and an annular part connected to the front portion of said outer body and surrounding the front end of the connector, an insulating part also being disposed at the front end of said connector and a pin connected to the core of said cable, insulating bushes also being provided around said core in the mid-portion of the connector.

2. A connector according to claim 1, including gaps provided between said parts of conical cross-section, said conductive connection member, said clamping component and said insulating bushes, said gaps being filled in with an insulating compound.

3. A connector according to claim 1, including firstly an outer packing gasket disposed between the rear portions of said body and of said insulating sleeve and clamped by a hollow nut, and secondly an inner packing gasket disposed between the rear portion of said sleeve and the cable.

4. A connector according to claim 1, including a guide part for the cable, which part is disposed in the hollow portion of the clamping nut of said outer packing gasket.

5. A connector according to claim 1, including seal rings disposed in recesses provided in the front portions of the body and of the annular part which is connected to the front portion of said body.

6. A connector according to claim 1, including a nozzle-shaped ring one of whose ends is inserted under the outer conductor of said cable, said ring being suitable for holding said electrically insulating covering while making the outer conductor of said cable continuous and maintaining its impedance.

* * * * *